US006118363A

United States Patent [19]

Chanteau et al.

[11] Patent Number: 6,118,363

[45] Date of Patent: Sep. 12, 2000

[54] SELF-INDUCTANCE ELEMENT

[75] Inventors: Pierre Chanteau, La Haye Malherbe; Hubert Paquet, Argenteuil, both of France

[73] Assignee: U.S. Philips Corporation, New York, N.Y.

[21] Appl. No.: 09/258,431

[22] Filed: Feb. 26, 1999

[30] Foreign Application Priority Data

Mar. 3, 1998 [FR] France ..... 98 02545

[51] Int. Cl.[7] ..... H01F 27/28

[52] U.S. Cl. ..... 336/180; 336/234

[58] Field of Search ..... 336/180, 212, 336/234

[56] References Cited

U.S. PATENT DOCUMENTS

| | | | |
|---|---|---|---|
| 2,279,239 | 4/1942 | Meyerhans | 336/212 |
| 5,767,759 | 6/1998 | Rouet | 336/174 |
| 5,805,042 | 9/1998 | Chastain et al. | 336/170 |

*Primary Examiner*—Michael L. Gellner
*Assistant Examiner*—Anh Mai

[57] ABSTRACT

This element comprises a winding (4, 5) wound on a rectilinear magnetic core formed by various ferrite rods (1, 2, 3) placed side by side as in a bundle, and the winding is wound partly in one direction (9) and partly in the other (10). Application: Cable television distribution.

6 Claims, 1 Drawing Sheet

SELF-INDUCTANCE ELEMENT

BACKGROUND OF THE INVENTION

The present invention relates to a self-inductance element comprising a coil winding on a rectilinear magnetic core.

Such an element is used in cable television distribution systems.

An element as defined in the opening paragraph above is known from EP 0 642 142. (U.S. Pat. No. 5,767,759) According to this document, a coil comprises a single winding wound on a magnetic core formed by a plurality of ferrite cylinders placed and to end.

A cable television distribution system comprises antennas, amplifiers, cables and distributors; a self-inductance element placed in these distributors enables to pass comparatively strong 50 Hz DC or AC supply currents so as to supply the amplifiers with power via the cables from power supplies situated in a building. The range of frequencies flowing through these systems being very wide, it is hard to achieve that this element has both a high impedance at the lowest frequencies (5 MHz) and no resonance at the highest frequencies. In addition, when a strong AC current passes through the element, there is a risk of a parasitic modulation phenomenon occurring at 50 Hz due to a periodic saturation of the magnetic core.

SUMMARY OF THE INVENTION

It is an object of the invention to obtain a proper functioning in a frequency range extending from 5 MHz to 3000 MHz, while a 50 Hz AC current of at least 5 amperes flows through the element.

For this purpose, the magnetic core is formed by various ferrite rods placed side by side in a bundle and the winding is wound partly in one direction and partly in the other.

These and other aspects are apparent from and will be elucidated with reference to the embodiments described hereinafter, which constitute a non-limitative example.

DETAILED DESCRIPTION OF THE PREFERRED EMBODIMENTS

Figure 1:
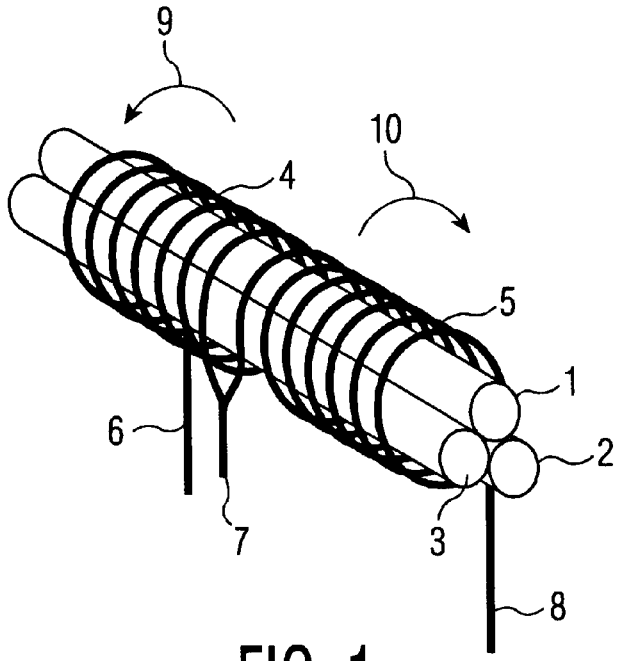
FIG. 1 represents an element according to the invention seen in a perspective view and FIG. 2 represents an example of use of use of such an element.

The element comprises a winding wound on a rectilinear magnetic core formed by various ferrite rods 1, 2, 3 placed side by side in a bundle. Here there are three and they are arranged with their axes equidistant from each other, forming an equilateral triangle.

The winding is partly wound in one direction and partly in the other. It is formed by a first part 4 between the input 6 and a center point 7 and a third part 5 between the center point 7 and the output 8, these two parts being, for example, of equal length (having the same number of turns). It is also possible for one of the parts to have one turn more than the other part. In the part 4 the wire is wound in the direction indicated by the arrow 9 and in the part 5 the wire is wound in reverse direction indicated by the arrow 10. The two parts are connected, for example, by soldering at point 7. At this point, the wire could also be folded to be distributed in the opposite direction.

For example, a current of 6 amperes, 50 Hz or 100 Hz may be caused to flow in an element formed by three soft ferrite rods of the type called "4B1", the coil being made by two times 11.5 contiguous turns of 70/100 wire having a diameter from 4 to 5 mm. The best results are obtained when the wire is wound directly on the bundle of ferrite rods, that is, without a support spindle.

Figure 2:
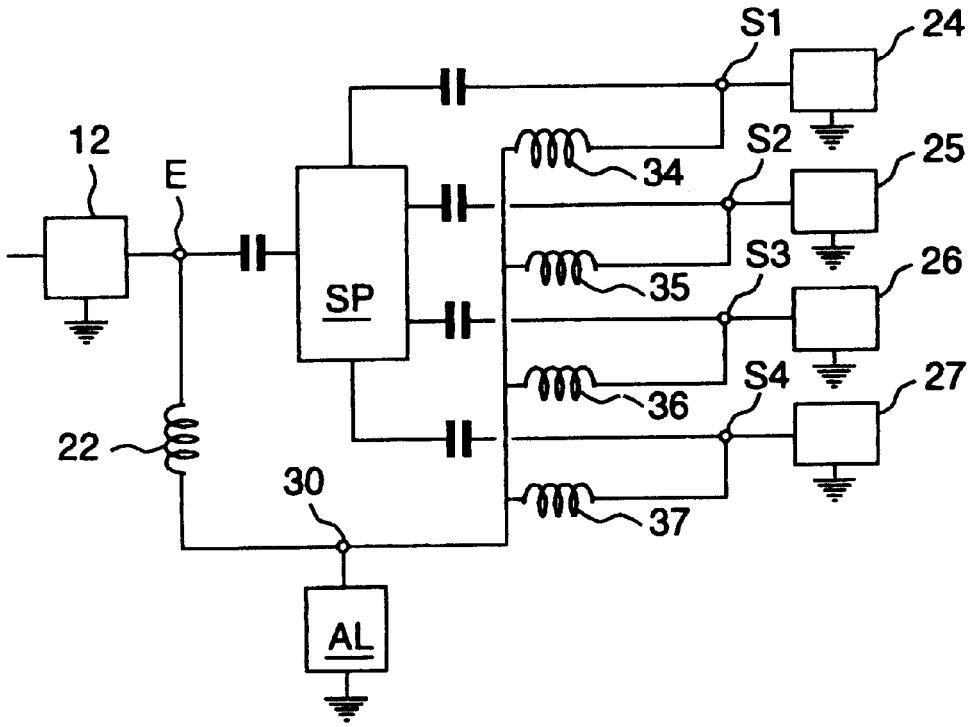

The distributor of FIG. 2 forms part of, for example, a television distribution network (not shown), it splits up a signal on an input E to send it to four outputs S1, S2, S3, S4. Upstream of the input E there is an electronic circuit 12 that needs to be supplied with power. Downstream of the outputs S1, S2, S3, S4 there are some electronic circuits 24, 25, 26, 27 each needing a power supply. The module SP is a module known per se which realizes the distribution of the high-frequency signals. The supply current is produced by a power source AL on the connection 30 and reaches the circuits 12, 24, 25, 26 and 27 via the respective elements 22, 34, 35, 36, 37 each being of the model described above and represented by the FIG. 1.

What is claimed is:

1. A self-inductance element comprising a winding wound on a rectilinear magnetic core, wherein said magnetic core is formed by a plurality of ferrite rods placed side by side in a bundle, and wherein the winding comprises a first part wound in one direction and a second part wound in another direction.

2. A self-inductance element as claimed in claim 1, characterized in that there are three ferrite rods.

3. A self-inductance element as claimed in claim 2, characterized in that the three ferrite rods have axes disposed equidistantly from each other.

4. A self-inductance element as claimed in claim 1, wherein one of the parts has one turn more than the other part.

5. A self-inductance element as claimed in claim 1 wherein the parts have the same number of turns.

6. A self-inductance element as claimed in claim 1, characterized in that the winding is made of a wire directly wound on the bundle of ferrite rods.

* * * * *